United States Patent [19]

Roth

[11] Patent Number: 5,037,087

[45] Date of Patent: Aug. 6, 1991

[54] ROLL BAR AND WATER WEIGHT EXERCISER

[76] Inventor: Peter Roth, 1450 Lake Shore Dr., Massapequa Park, N.Y. 11762

[21] Appl. No.: 566,552

[22] Filed: Aug. 13, 1990

[51] Int. Cl.[5] ..... A63B 21/06

[52] U.S. Cl. ..... 272/117; 215/272; 215/228; 215/293; 403/165; 403/290; 272/67

[58] Field of Search ..... 215/272, 228, 100 R, 215/293; 272/117, 67; 403/165, 290; 220/287, 255

[56] References Cited

U.S. PATENT DOCUMENTS 3,982,755 9/1976 Sarich ..... 272/117

*Primary Examiner*—V. Millin
*Assistant Examiner*—Jerome W. Donnelly
*Attorney, Agent, or Firm*—Notaro & Michalos

[57] ABSTRACT

A wrist exerciser comprises first and second neck engaging members which each carry a neck receiving recess for engagement around the neck of a bottle. The bottle is at least partly filled with water and acts as a weight. One end of a rope is connected to an upper end of the first and second members while the opposite end of the rope is connected near the middle of a bar. Opposite ends of the bar carry handles which can be held by a user who rotates the bar to roll the rope on the bar and thereby lift and lower the bottle.

19 Claims, 2 Drawing Sheets

ROLL BAR AND WATER WEIGHT EXERCISER

FIELD AND BACKGROUND OF THE INVENTION

The present invention relates in general to exercise devices, and in particular to a new and useful wrist exerciser which utilizes a bottle filled with liquid as the weight.

Wrist exercisers are known from U.S. Pat. No. 3,982,755 which include a bar having opposite ends to be held by the hands of a user, with a rope hanging from the center of the bar which is connected to a bottle that can be filled with liquid to act as a weight. Exercise is accomplished by rotating the bar between the hands to roll the rope onto the bar and thereby raise the weight. No special arrangement is made in this patent, however, for connecting the rope to the container.

Other similar wrist exercisers are disclosed in U.S. Pat. Nos. 4,411,423 and 4,438,920.

U.S. Pat. No. 4,695,051 discloses a dumbbell which is filled with water to provide weight for the dumbbell.

SUMMARY OF THE INVENTION

The present invention comprises a wrist exerciser having a bar with opposite ends to be held by the hands of a user, cord means such as a rope or band, connected to the bar and adapted to be wound on the bar when the bar is rotated, and bottle neck engaging means connected to a lower end of the cord means for engagement to the neck of a bottle which is at least partly filled with liquid to act as a weight. The user rotates the bar in his or her hands to roll up the cord means and thus raise the bottle. Rotation in the opposite direction of course lowers the bottle.

The bottle neck engaging means may be in the form of at least one neck engaging member having a neck receiving recess for at least partly embracing the neck of a bottle to thereby connect the bottle to the bar through the cord means in a convenient manner.

Advantageously, two neck engaging members are used in conjunction with each other, each having a C-shaped recess for engaging opposite sides of the bottle neck. The neck engaging members are held together by a resilient or split ring which is engaged around the members to urge them toward each other.

A rope connection in the form of a hole is formed in one or both neck engaging members. The rope or band can be tied or otherwise connected through the hole.

Alternate for holding the neck engaging members together is a screw or bolt engaged through aligned holes in the two neck engaging members which are held together by a nut, such as a hex or wing nut, threaded onto the bolt or screw.

The bolt or screw may itself act as the rope connection, with a loop of the rope or band extending around the screw or nut.

An object of the present invention is thus to provide a wrist exerciser which has a simple, economic and rugged mechanism for connecting the exerciser to a bottle such as a plastic soda bottle or the like. As an incidental advantage, the invention recycles at least one item which would otherwise represent waste, namely the discarded bottle.

DESCRIPTION OF THE PREFERRED EMBODIMENTS

Figure 1:
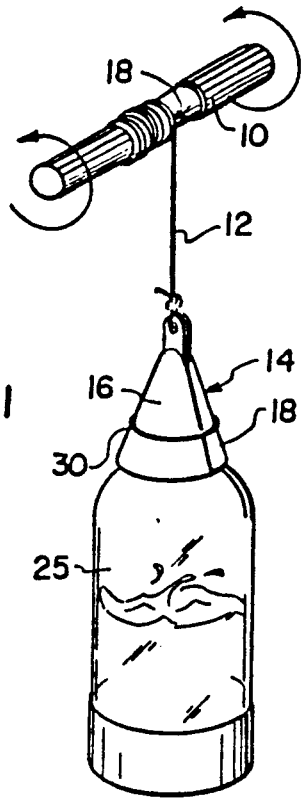
FIG. 1 is a perspective view showing the wrist exerciser of the present invention engaged to a plastic soda bottle.

Referring to the drawings in particular, the invention embodied in FIG. 1 comprises a wrist exerciser having a bar 10 with opposite ends which may each be covered by a rubber handle of the type found on bicycles. The central area of bar 10 is uncovered and connected to the upper end of cord means which may be any elongated flexible member such as rope 12. Bands, flexible cable, wires, heavy strings or other suitable elongated flexible members may also be used. The upper end of rope 12 is connected through a central radial hole in rod 10 and anchored, for example by a knot 18.

The lower end of rope 12 is connected to bottle neck engaging means 14 at a rope connection, for example a hole passing through the bottle neck engaging means through which the rope is tied. A bottle 25, such as a one liter or half gallon plastic soda bottle, is suspended from bottle neck engaging means 14. Bottle 25 is either partly or completely filled with water to adjust the amount of weight desired for the exerciser.

In use, bar 10 is rotated in the direction of the arrows to roll the cord means onto the bar between the handles. Exercise continues by slowly rotating bar 10 in the opposite direction to unwind the cord means and lower the bottle.

Figure 2:
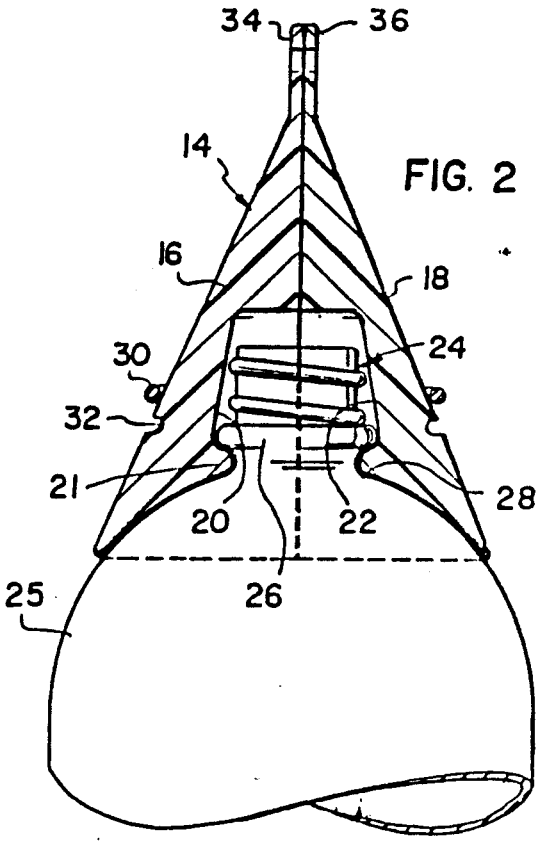
FIG. 2 is a partial sectional view of FIG. 1.

As best shown in FIG. 2, bottle neck engaging means 14 comprises a pair of identical neck engaging members 16 and 18 which each are molded of plastic which may be resilient or rigid. Each neck engaging member 16, 18 includes a neck receiving recess 20, 24 which engages bottle neck 24. A resilient or split ring 30 is pressed down over the conical outer contour of the mated members 16, 18 and squeezed into an annular groove 32 defined around the mated members. If resilient material is used to construct the members 16 and 18, ring 30 may be rigid and rely on the resiliency of the bottle neck engaging means to allow it to be pressed into groove 32. If ring 30 is resilient or a split ring, it momentarily opens as it is being squeezed into groove 32 from the top, and thereafter resumes its initial shape, firmly held within the groove. FIG. 2 shows ring 30 before it is engaged in groove 32.

Projections 21 at the base of each neck receiving recess 20, 22 are shaped to engage around a circumferential groove 28 formed below a circumferential projection 26 in the bottle neck 24. Alternatively, recesses 20, 22 may be shaped to receive the thread at the top of the bottle in a manner not shown. The bottle neck engaging means 14 may even be formed of a single piece with a threaded recess for threadably receiving the bottle neck and thus act as a replacement cap therefor.

In the embodiment shown in the figures, enough room is left in or above the recess to accommodate the usual cap (not shown) for bottle 25.

In the embodiment of FIG. 2, each member 16, 18 includes an upwardly extending tab 34, 36 with aligned holes that forms a rope connection for rope 12.

Figure 3:
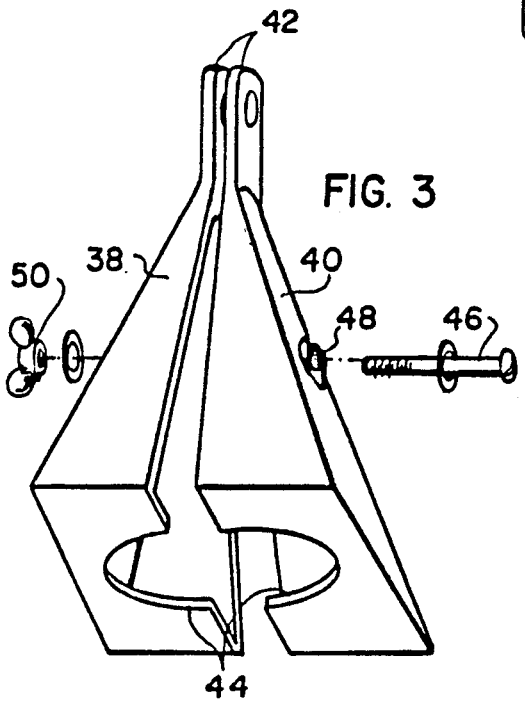
FIG. 3 is a perspective view of a second embodiment of the invention.

FIG. 3 shows a second embodiment of the invention comprising a pair of pyramid shaped neck engaging members 38, 40 which have upwardly extending tabs 42 with holes therethrough that are aligned when the members are engaged with each other. Each member is substantially hollow but includes a lower bottom wall with a C-shaped recess 44 for embracing opposite sides of a bottle neck. The members 38, 40 are held together by a bolt or screw 46 which extends through aligned reinforced holes 48 in each of the members. A wing nut 50 is threaded onto an end of screw 46 for holding the members together. Washers may also be used on opposite sides of the members 38, 40.

Figure 4:
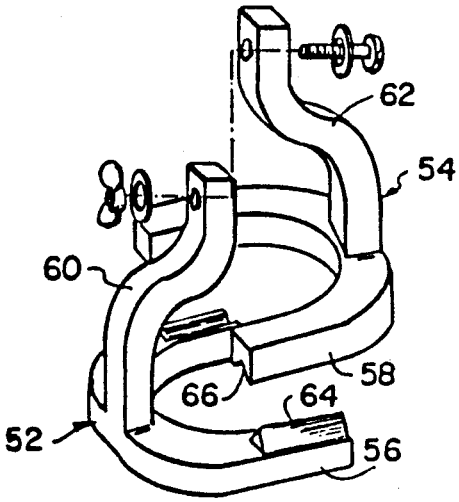
FIG. 4 is a perspective view of a third embodiment of the invention.

FIG. 4 shows a still further embodiment of the invention where a pair of neck engaging members 52, 54 each comprise a lower bracket 56, 58 having a C-shaped recess therein, and a support portion 60, 62 extending upwardly for the support bracket and including an upper end with holes which are meant for alignment and engagement by a bolt and wing nut combination.

As with the other embodiments, the C-shaped recesses cooperate to trap a bottle neck therebetween. Unlike the embodiments of FIGS. 2 and 3 however, bracket 58 is engaged on top of bracket 56 when the connecting holes are aligned and fixed by the nut and bolt combination. Each bracket is a fork like arrangement with a pair of fingers. To insure alignment of the fingers, the upper surface of bracket 56 includes a projection such as a tenon 64 which fits into a groove or mortise 66. Bracket 56 may include a pair of tenons or a tenon on one finger and a mortise on the other. Conversely, the surface of bracket 58 may include a pair of tenon or a combination of tenon plus mortise which compliments the arrangement on the upper surface of bracket 56.

To engage the lower end of rope 12 to the embodiment of FIG. 4, the rope is either looped between the connected support portions 60, 62 or squeezed between these portions by the nut and bolt combination.

Figure 5:
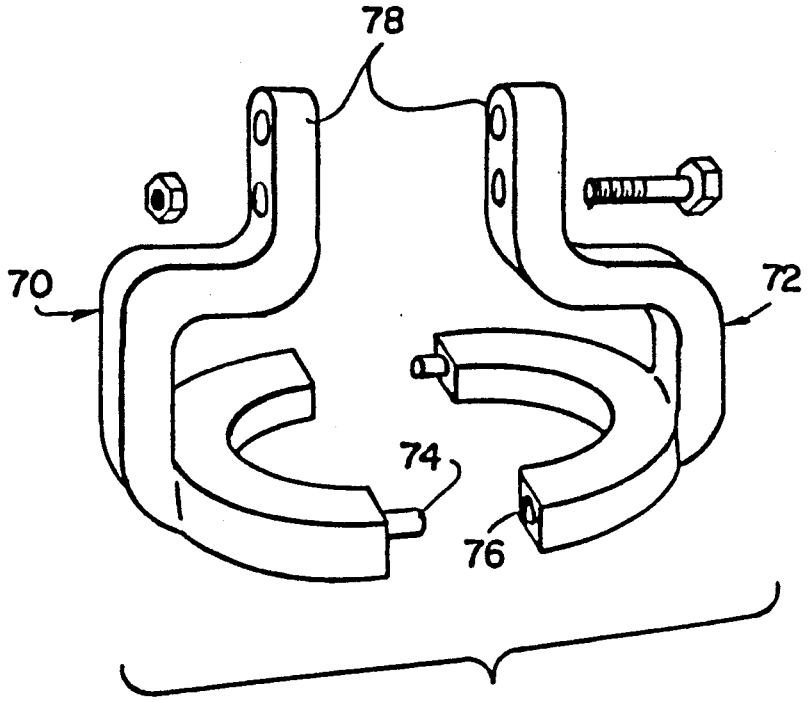
FIG. 5 is a perspective view of a fourth embodiment of the invention.

FIG. 5 shows a still further embodiment of the invention where each neck engaging member 70, 72 includes a lower fork or bracket with outer ends that abut each other. A peg 74 in the end of one finger engages a blind bore 76 in the end of a mating finger. The opposite fingers of each fork or bracket likewise include a complementary peg plus bore.

The rope connection is provided by a tab or extension 78 at the upper end of each support portion for each member 70, 72 which, when the members are engaged with each other by a nut plus bolt combination, can receive the lower end of the rope for band 12. Separate aligned holes are thus provided for the bolt plus nut combination.

Figure 6:
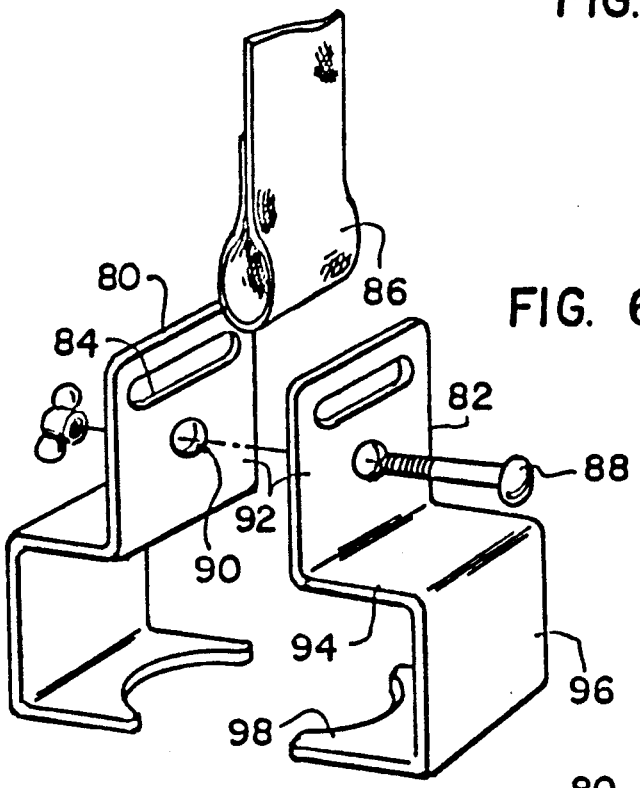
FIG. 6 is an exploded view of a fifth embodiment of the invention.
Figure 7:
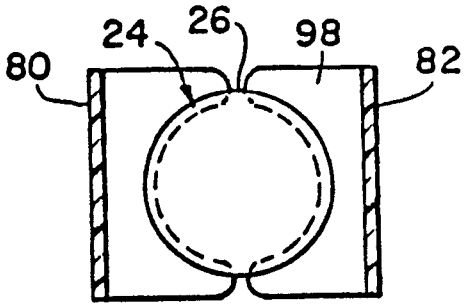
FIG. 7 is a plan view, partly in section, of the fifth embodiment.

The embodiment of FIGS. 6 and 7 comprises a pair of bottle neck engaging members 80 and 82 which are each made of individual single strips of plastic which is bent, for example by heating, to form vertical panels 92 which each have a slot shaped opening 84 for receiving the loop of a cord means in the form of a flat band or strap 86, and a pair of holes 90 for receiving a bolt plus nut combination 88.

An outwardly extending upper panel 94 is connected to the bottom edge of each upstanding panel and a side panel 96 is connected to the outer edge of each upper panel 94. Each neck engaging member is completed by a lower inwardly extending panel 98 having a recess therein for engaging around opposite ends of a bottle neck 24 as shown in FIG. 7. The thickness of plastic material used to construct the members 80 and 82 is selected to be thin enough to engage under the circumferential projection 26, but thick enough to provide the members with sufficient strength to embrace and support the bottle. The use of a strap 86 instead of a cord or cable is advantageous in that it resists spinning or rotation of the bottle as the exercise is conducted.

What is claimed is:

1. A wrist exerciser comprising:

a bar having opposite ends adapted to be held by the hands of a user for rotation of said bar;

cord means having one end connected to said bar for rolling of said cord means on said bar with rotation of said bar; and means for connecting a bottle having a neck to an opposite end of said cord means, including a bottle-neck engaging member including at least one neck engaging member having a neck receiving recess for embracing at least part of a bottle neck for connecting a bottle having the bottle neck to said cord means, and a connection connected to said neck engaging member for connecting said bottle neck engaging means to said cord means.

2. An exerciser according to claim 1 wherein said bottle neck engaging means comprises a first neck engaging member having a first neck receiving recess and a second neck engaging member having a second neck receiving recess, said first and second members being engageable with each other for communicating said neck receiving recesses thereof with each other for substantially embracing a bottle neck between said first and second members, said bottle neck engaging means including retaining means for holding said first and second members to each other.

3. An exerciser according to claim 2 wherein said retaining means comprises a groove formed around said first and second members and a ring engagable into said groove for holding said first and second members together.

4. An exerciser according to claim 3 wherein said connection comprises a tab connected to at least one of said first and second members, and a hole through said tab.

5. An exerciser according to claim 4 wherein each of said neck receiving recesses includes a C-shaped portion for engaging one side of a bottle neck.

6. An exerciser according to claim 5 wherein said first and second members form a conical shape having an interior defining said neck receiving recesses, said groove formed around said conical shape.

7. An exerciser according to claim 2 wherein each of said first and second members are hollow and include a bottom wall carrying said neck receiving recess, each neck receiving recess being C-shaped.

8. An exerciser according to claim 7 wherein said connection comprises a tab connected to at least one of said first and second members and having a hole therethrough for receiving the opposite end of said cord means, said retaining means comprise aligned holes in said first and second members and a bolt plus nut combination extending through said aligned holes.

9. An exerciser according to claim 2 wherein each of said first and second members comprises a fork-shaped bracket and a support portion connected to said fork-shaped bracket, said connection being carried by said support portions, each fork-shaped bracket defining said neck receiving recess.

10. An exerciser according to claim 9 including mortise and tenon means connected between said fork-shaped brackets of said first and second members for engaging said fork-shaped brackets to each other around a bottle neck.

11. An exerciser according to claim 10 wherein said fork-shaped bracket of said first member has a lower surface for mating with an upper surface of said fork-shaped bracket of said second member, said upper and lower surfaces of said first and second members carrying said mortise and tenon means.

12. An exerciser according to claim 10 wherein each of said fork-shaped brackets has an outer abutment surface, said outer abutment surfaces being engaged with each other for communicating the neck receiving recesses of said first and second members with each other, said mortise and tenon means comprises a peg extending from one of said abutting surfaces and a hole in the other of said abutting surfaces for receiving said peg.

13. An exerciser according to claim 10 wherein said connection comprises a space between said support portions when said first and second members are engaged with each other.

14. An exerciser according to claim 10 wherein said connection comprises a projection on at least one of said support portions with a hole therethrough for receiving the opposite end of said cord means.

15. An exerciser according to claim 10 wherein said retaining means comprises a nut and bolt combination extending through said support portions of said first and second members for holding said first and second members to each other.

16. An exerciser according to claim 2 wherein each neck engaging member comprises a strip of plastic material bent to form an upstanding panel, an upper panel connected to and extending outwardly from the upstanding panel, a connecting panel extending downwardly from an outer edge of the upper panel, and a lower inwardly extending panel carrying said neck receiving recess.

17. An exerciser according to claim 16 wherein said retaining means comprises a bolt and nut combination extending through said upstanding panels.

18. An exerciser according to claim 16 including an opening in each of said upstanding panels for receiving said cord means.

19. An exerciser according to claim 18 wherein said cord means comprises a strap, said opening being slot shaped.

* * * * *